US012044499B2

(12) United States Patent
Wutte

(10) Patent No.: US 12,044,499 B2
(45) Date of Patent: Jul. 23, 2024

(54) CONNECTION FOR THE UPPER RECEIVER PART AND THE LOWER RECEIVER PART OF A FIREARM

(71) Applicant: GLOCK TECHNOLOGY GMBH, Ferlach (AT)

(72) Inventor: Andreas Wutte, Ferlach (AT)

(73) Assignee: GLOCK TECHNOLOGY GMBH, Ferlach (AT)

( * ) Notice: Subject to any disclaimer, the term of this patent is extended or adjusted under 35 U.S.C. 154(b) by 0 days.

(21) Appl. No.: 18/044,770

(22) PCT Filed: Jul. 7, 2021

(86) PCT No.: PCT/EP2021/068813
§ 371 (c)(1),
(2) Date: Mar. 9, 2023

(87) PCT Pub. No.: WO2022/053198
PCT Pub. Date: Mar. 17, 2022

(65) Prior Publication Data

US 2023/0341200 A1 Oct. 26, 2023

(30) Foreign Application Priority Data

Sep. 10, 2020 (EP) ..... 20195503

(51) Int. Cl.
*F41A 3/66* (2006.01)

(52) U.S. Cl.
CPC ..... *F41A 3/66* (2013.01)

(58) Field of Classification Search
CPC ..... F41A 3/66
See application file for complete search history.

(56) References Cited

U.S. PATENT DOCUMENTS

| | | | | |
|---|---|---|---|---|
| 3,318,192 | A | 5/1967 | Arthur | |
| 7,941,958 | B1 | 5/2011 | Zedrosser | |
| 9,188,399 | B1 * | 11/2015 | Findlay | F41A 3/66 |
| 9,909,828 | B1 | 3/2018 | Klein | |
| 2011/0099874 | A1 | 5/2011 | Zedrosser | |
| 2017/0016690 | A1 | 1/2017 | Timmons | |
| 2017/0234646 | A1 * | 8/2017 | Flagler | F41C 23/16 42/71.01 |
| 2018/0187989 | A1 * | 7/2018 | Jen | F41A 11/00 |

FOREIGN PATENT DOCUMENTS

| | | | |
|---|---|---|---|
| DE | 1453908 | A1 | 7/1970 |
| EP | 2045560 | A3 | 11/2012 |

* cited by examiner

*Primary Examiner* — Reginald S Tillman, Jr.
(74) *Attorney, Agent, or Firm* — Raven Patents, LLC; Anton E. Skaugset

(57) ABSTRACT

Firearms having an upper receiver part and a lower receiver part that are detachably connected to each other by a connecting mechanism so that the two receiver parts are pivotable relative to each other between a closed and an open position. The connecting mechanism includes at least one pivot pin, running normal to the median plane, and a pivot pin hole passing through the upper and/or the lower normal to the median plane, a connector element with at least one hole and a slotted hole and a protrusion formed on the upper or lower, running in the direction of the barrel axis, and a recess which is complementary thereto in shape and function.

20 Claims, 8 Drawing Sheets

CONNECTION FOR THE UPPER RECEIVER PART AND THE LOWER RECEIVER PART OF A FIREARM

TECHNICAL FIELD

The present disclosure relates to firearms, and more particularly to firearms having an upper receiver part and a lower receiver part that are detachably connected to each other by a connecting mechanism so the two receiver parts are pivotable relative to each other between a closed and an open position.

BACKGROUND

Firearms with a multi-part receiver have been known for a long time. Examples include the types M4/M16/AR15 or H&K G3, and their derivatives. In these firearms, the upper receiver part is connected to the lower receiver part by means of pins which run normal to the central plane of the firearm. The upper receiver part and the lower receiver part are inserted into each other during assembly; corresponding holes are provided in both parts, such that a front pin (also known as a pivot pin) and a rear pin (also known as a takedown pin) can be inserted, thereby producing the receiver connection.

By removing the rear pin, the upper receiver part can be opened about the axis of the front pin—hence the term "pivot pin." In the open state, the breech is accessible and the firearm can be cleaned without completely disassembling it. To completely disassemble the firearm, the front pin must also be removed. Such mechanisms are known from the U.S. Pat. No. 9,909,828 B1 and the US 2017/0016690 A1.

Modifications are known, for example, from DE 145 39 08 A1, where a hinge is provided instead of the pivot pin, and the fixation takes place by means of a rotatable cam. Although the opening is simplified as a result, and the risk of loss is eliminated, a complete disassembly is extremely cumbersome. This, by way of example, practically prevents changing the barrel—necessarily with the upper in which it is mounted—in the field.

EP 2 045 560 discloses the use of a type of pseudo-joint as a pivot pin, and a connecting device made of elastomer material at the rear end of the firearm. This soft connection cannot cope with the harsh operating conditions in the field; in practice this design does not occur.

As simple as the first arrangement may appear at first glance, it has its disadvantages: Despite various countermeasures, (both) pins are easy to lose, and significant forces—and in particular, shocks—are transmitted between the two receiver parts via the pins, such that these and the bearings are heavily loaded. Since the pins also substantially align the two parts relative to each other, any geometric changes to the pins are extremely negative due to the high load.

The contents of the U.S. Pat. No. 9,909,828 B1, the US 2017/0016690 A1, the DE 145 39 08 A1, the corresponding U.S. Pat. No. 3,318,192, the EP 2 045 560 and the corresponding US 2011/0099874 A1 and U.S. Pat. No. 7,941,958 B1 disclosures are incorporated by reference into the content and disclosure of the present application for all jurisdictions which allow such an incorporation.

What is needed, therefore, is a mechanically solid connection between the upper receiver part and the lower receiver part of a firearm, a connection that can be easily disassembled, and in particular a connection having only one pivot pin.

SUMMARY

The present disclosure is directed to firearms, and in particular to firearms having an upper receiver part and a lower receiver part that are detachably connected to each other by a connecting mechanism so that the two receiver parts are pivotable relative to each other between a closed and an open position. The disclosure further includes connector elements suitable for such firearms, upper receiver parts suitable for such firearms, lower receiver parts suitable for such firearms, and abutments on such receiver parts.

In some examples, the firearms of the present disclosure exhibit a weapon median plane, and the firearm includes an upper receiver part including a barrel having a barrel axis, and a lower receiver part that is detachably connected to the upper receiver part by a connecting mechanism. The connecting mechanism includes at least one pivot pin having a pivot pin axis normal to the weapon median plane, so that the upper receiver part and the lower receiver part are pivotable around the pivot pin axis between an open position and a closed position in which the firearm is in a ready-to-fire state. The connecting mechanism further includes a receiver pivot pin hole defined by and passing through the upper receiver part and/or the lower receiver part, where the receiver pivot pin hole defines a receiver pivot pin hole axis that is normal to the weapon median plane. The connecting mechanism further includes a connector element having at least one hole and at least one slotted hole, where each of the hole and the slotted hole define axes that are normal to the weapon median plane. The connecting mechanism further includes a protrusion formed on the upper receiver part or lower receiver part in the direction of the barrel axis, and a corresponding recess defined by the upper receiver part or lower receiver part that is complementary in shape and function to the protrusion.

DETAILED DESCRIPTION

Figure 1:
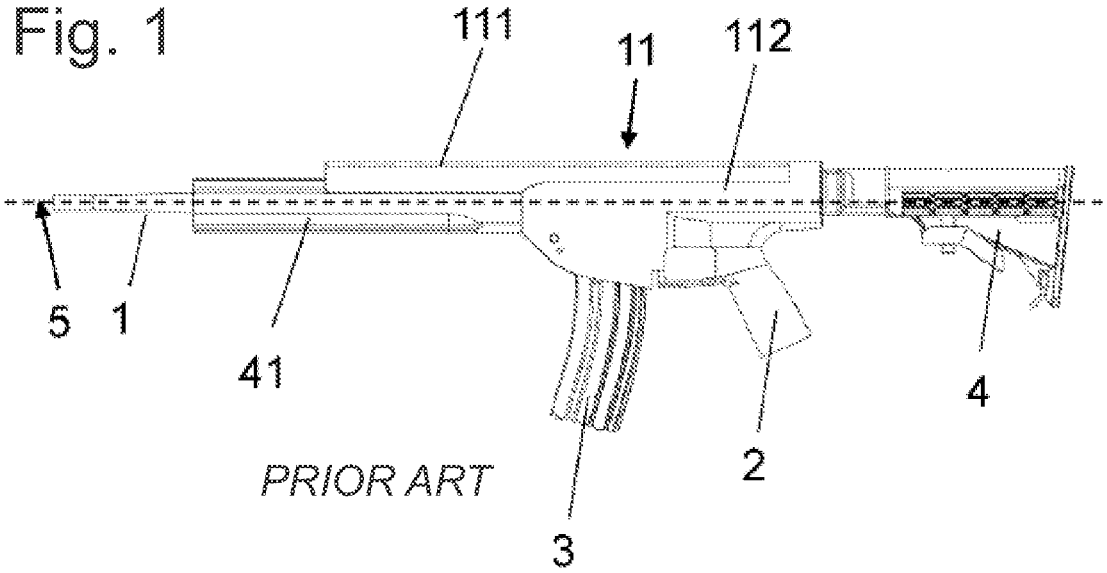
FIG. 1 shows a simplified representation of a firearm according to the prior art.

The firearms of the present disclosure possess a mechanically solid connection between their upper receiver part and their lower receiver part, a connection exhibiting a number of advantageous properties, including the ability to be easily disassembled.

The connecting mechanism of the firearms described herein includes at least one pivot pin, a receiver pivot pin hole, and a connector element, and the connecting mechanism works together with projections or recesses of the upper receiver part or lower receiver part of complementary shape. In the simplest case, the receiver pivot pin hole corresponds to a bore and can be formed on the upper receiver part (upper) and/or the lower receiver part (lower), and has a receiver pivot pin hole axis 121 that is normal to the weapon median plane. The connector element has at least one hole and one slotted hole, the axes of which are normal to the weapon median plane.

Preferably, the pivot pin is designed to work together with the receiver pivot pin hole and the connector element, the pivot pin reaching at least through the lower (and/or upper) and at least through the slotted hole and the hole, wherein the slotted hole has its longitudinal extension, in the closed state, parallel to the barrel axis. Regions of complementary shape, namely at least one protrusion and/or one recess, are formed on the upper and the lower in such a way that they are in contact with each other (and prevent movement between the upper and lower in the weapon median plane, and normal to the barrel axis) when the pin is situated in an end region of the slotted hole, and in such a way that they are spaced from each other (and allow a movement between the upper and the lower in the weapon median plane, and normal to the barrel axis) when the pin is situated in the other end region of the slotted hole.

The listed components, such as the receiver pivot pin hole, connector element, protrusion and recess can, depending on requirements, be arranged by a person skilled in the art on the upper receiver part and/or the lower receiver part in order to work together in the manner disclosed herein.

This enables the upper to be pivoted during assembly about the single pin, which is inserted in the slotted hole of the upper but not in its bore, until it rests on the lower; and then, possibly guided by guides, it is pushed in the direction of the barrel until the two complementary regions are in contact with each other. Then the pin located in the other end region of the slotted hole can also be pushed through (into) the bore of the upper; a stable connection is created by the combined action of the pin and the regions of complementary shape.

Practically the only condition that the regions of complementary shape must meet is that their geometry in the direction of the barrel axis is designed so that, in the closed state: parts of the upper have a greater distance axially from the pivot pin axis 247 than regions of the lower, and so that these parts of the upper are "below" the regions of the lower. Generally speaking, this can be described as "sticking" a projection of the upper into a recess of the lower in the direction of the barrel axis.

In this way, a mechanically very strong connection is established; the regions of complementary shape, due to their dimensions, can do more for the alignment, as well as for force or torque transmission, than the two pins known in the prior art. The pin itself can advantageously be provided with pull-out locks, etc., similar to the prior art, but this is no longer the focus of the present disclosure.

As in the prior art, it does not matter what additional parts the upper may contain besides the barrel and the firing mechanism, and it does not matter what additional parts the lower may contain besides the trigger mechanism, and therefore these are not explained in more detail here.

Various components of the firearm, such as the grip, the barrel, various safeties, the magazine well, or the magazine feed or shaft are described with reference to a rifle, such as a carbine. However, the connecting mechanism of the present disclosure is also suitable for use in pistols, in particular the so-called "modularly constructed" pistols. It should be understood that a person skilled in the art, with knowledge of the present disclosure, can make any necessary or desirable modifications based on their special technical knowledge.

Since the invention can be used not only with newly built and/or newly designed firearms, but can also be implemented by retrofit kits or conversion kits, the present disclosure is also directed to a multi-part connecting mechanism which comprises the pivot pin, the receiver pivot pin hole with its axis normal to the weapon median plane, a connector element with the hole and the slotted hole with axes normal to the weapon median plane, the protrusion running in the direction of the barrel axis and the recess which is complementary in shape and function. These elements can be fitted in a suitable manner on the upper and the lower, but they can also be designed to be entirely or partially integral with the upper/lower.

The firearms and connecting mechanisms of the present disclosure are explained below, and with reference to the drawings.

In the present disclosure, the terms left, right, up, down, front and back always refer to the firearm from the point of view of the firearm when it is held ready to fire. The firearm has a weapon median plane going through the barrel axis and oriented vertically, which substantially forms a plane of symmetry; the barrel has a barrel axis that is referenced in the following for further orientation.

In the description and the claims, the terms "front," "rear," "above," "below" and so on are used in the generally accepted form and with reference to the object in its usual use position. This means that, for the firearm, the mouth of the barrel is "at the front," that the breech is moved "rearward" by the explosive gas, etc. Transverse to a direction substantially means a direction which is rotated by 90° thereto.

FIG. 1 schematically illustrates a firearm having a barrel 1, grip 2, magazine 3, stock 4, handguard 41 and receiver 11, which comprises the upper receiver part 111 and the lower receiver part 112, and shows the barrel axis 5 with a dashed line.

Figure 2:
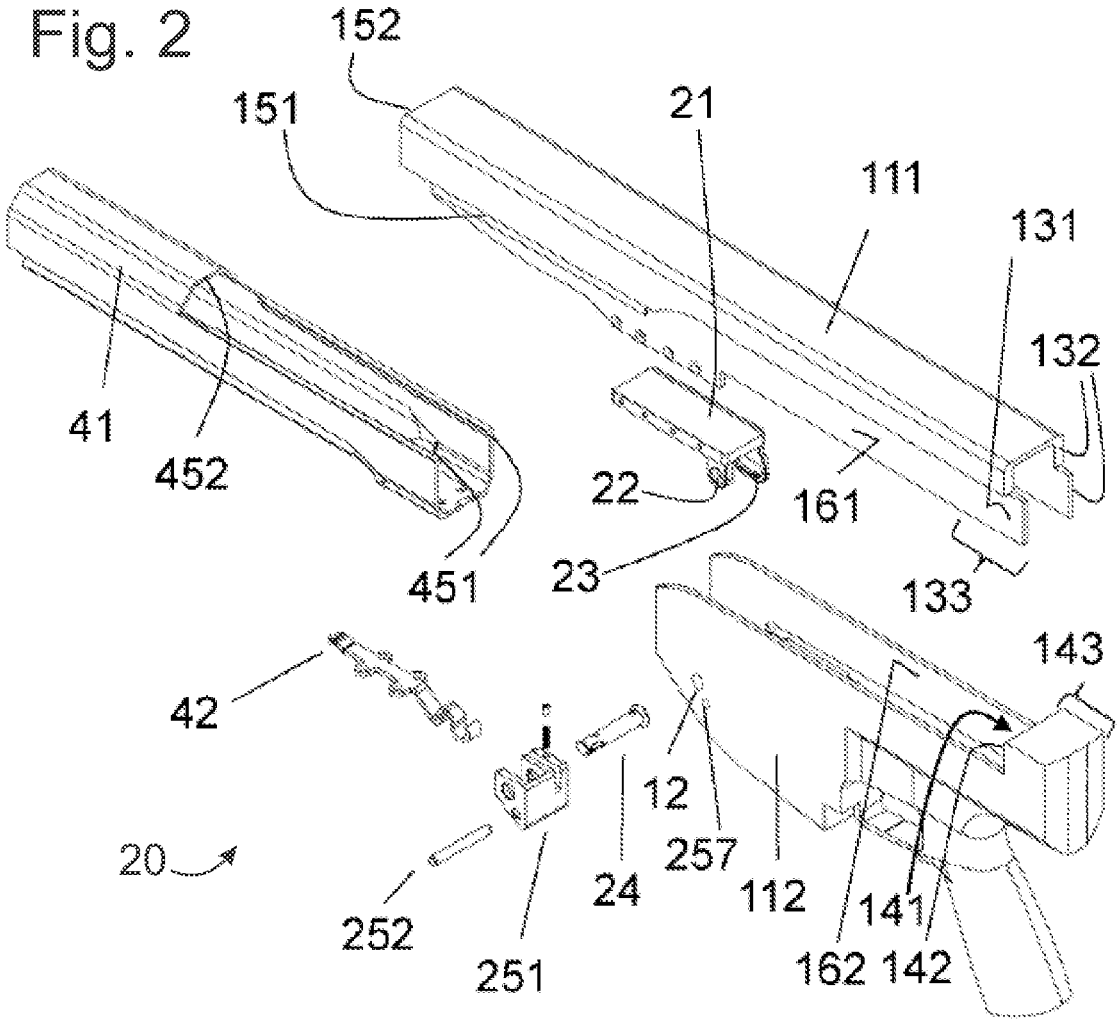
FIG. 2 shows a simplified exploded view of an illustrative firearm receiver according to the present disclosure, viewed from the rear.
Figure 3A:
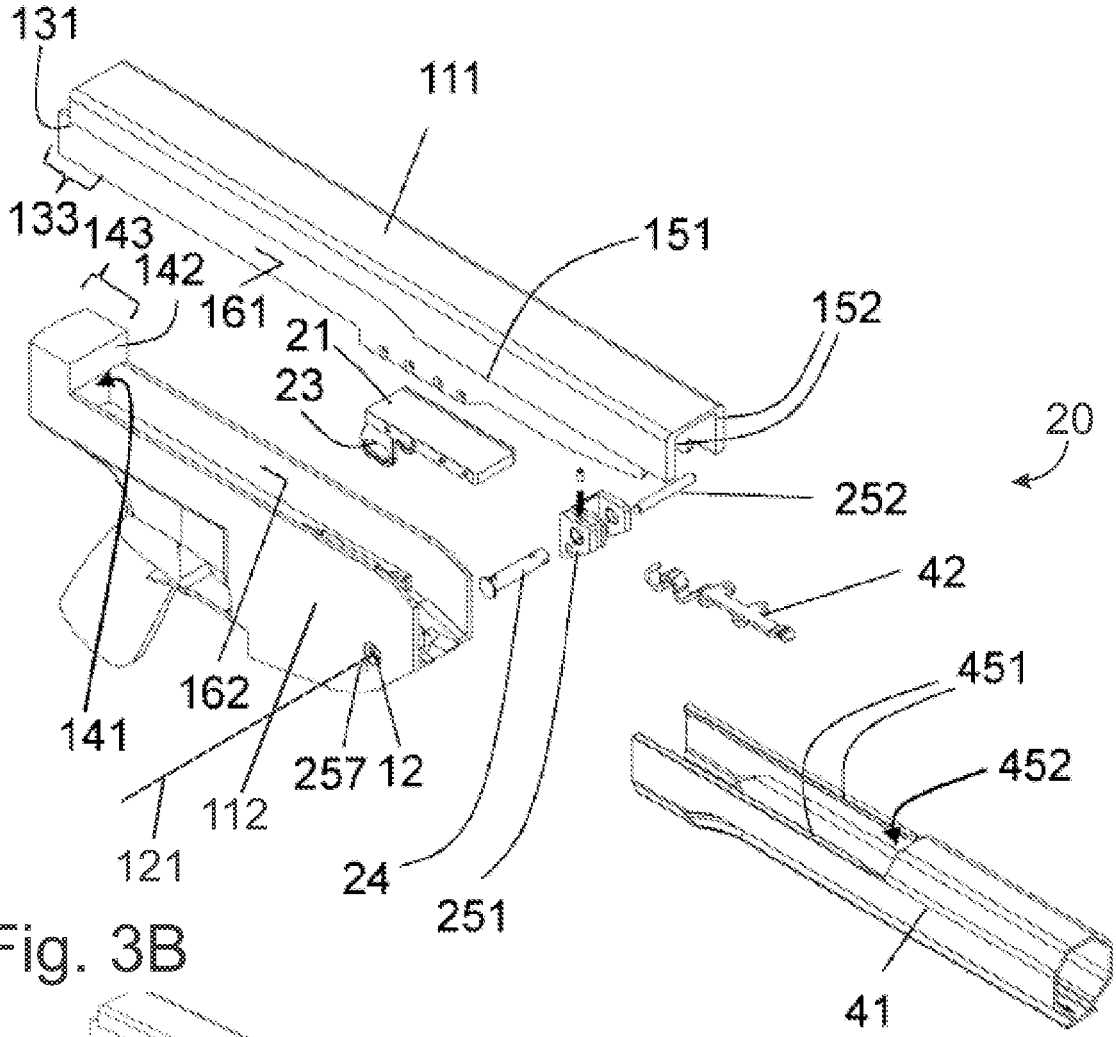
FIGS. 3A and 3B show a simplified exploded view of an illustrative firearm receiver according to the present disclosure, viewed from the front.
Figure 3B:
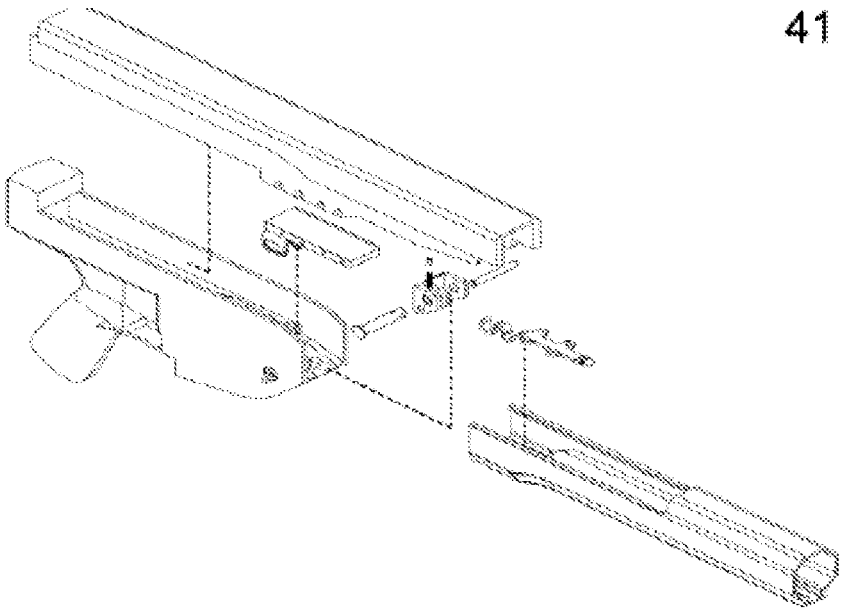

FIGS. 2 and 3A show exemplary exploded views of an exemplary firearm of the featuring a connecting mechanism 20 according to the present disclosure. In FIG. 3B, the arrangement of the components for assembly is indicated with dashed lines. The connection for the receiver 11 comprises the upper receiver part 111 and the lower receiver part 112, connector element 21 with hole 22 (initially and variously also referred to below as a bore) and slotted hole 23, pivot pin 24, and receiver pivot pin hole 12, as well as a protrusion 131 and recess 141, which are designed to be complementary to each other in shape and function.

In the embodiment shown, the protrusion 131 has a rear stop surface 132 on the end section 133 and is attached to the upper receiver part 111. The recess 141, which is complementary in shape and function, on the receiver end section 143 has a receiver counter surface 142 and, in the design shown, is formed on the lower receiver part 112. In the closed state (when the firearm is ready for use), the protrusion 131 lies in the recess 141, and the rear stop surface 132 lies directly on the receiver counter surface 142. A rearward power transmission from the upper receiver part 111 to the lower receiver part 112, as occurs, for example, when a shot is fired, takes place on the one hand via the rear stop surface 132 and the receiver counter surface 142, and on the other hand via the pivot pin 24, the connector element 21, and the receiver pivot pin hole 12.

The protrusion 131 and the recess 141 can be designed in numerous shapes that deviate from the illustrated embodiments, for example cylindrical, stepped, toothed shapes, etc. In equivalent embodiments, the protrusion 131 can also be formed on the lower receiver part 112, and the recess 141 can be formed on the upper receiver part 111.

The connector element 21 is mounted in the upper or formed in one piece (integrally) with it; it has a hole 22—cut out of a section called the "stud" 225, which in the assembled state runs substantially parallel to the weapon median plane 6 (shown as a dashed line in FIG. 5A)—with an axis normal to the weapon median plane 6, and has—on a section which in the assembled state also runs substantially parallel to the weapon median plane 6, called the "lug" 235—a slotted hole 23, the longitudinal extension of which, in the assembled state, runs parallel to the barrel axis 5. The rotary-sliding movement of the two parts relative to each other is made possible together with the receiver pivot pin hole 12 in the lower and the pivot pin 24.

In the embodiment shown, the handguard 41 is shown with a lock 42. On its front end (in the longitudinal direction), the handguard 41 completely surrounds the barrel; on the rear end, it is cut out at the top and has guide rails 451 on both sides, which are complementary in shape to the grooves 151 formed on both sides of the upper receiver part 111. To connect the handguard 41 to the upper receiver part 111, the handguard 41 and the upper receiver part 111 are inserted into each other in such a way that the grooves 151 receive the guide rails 451, until a front stop surface 152 strikes a mating surface 452 of the handguard 41. Due to the interaction of the guide rails 451 and the grooves 151, the handguard 41 is secured to the upper receiver part 111 against unwanted movement transverse to the barrel axis 5, and is secured against unwanted movement in the direction of the barrel axis 5 on the one hand by the interaction between the front stop surface 152 and the mating surface 452, and on the other hand by the lock 42 together with the pivot pin 24 (see FIGS. 8C and 8D).

In other embodiments, one or more stop surfaces, also with other shapes, can be formed—for example, step-shaped, surfaces with interruptions, etc.

Furthermore, instead of a handguard 41, other add-on parts such as a grenade launcher can also be secured by means of a lock 42.

FIGS. 2 and 3A also show an abutment 252 which is fastened in the lower 112 with a retaining pin 252 and which forms the actual guides for the pivot pin 24 in the lower; it is explained in detail with reference to FIG. 9.

Figure 8A:
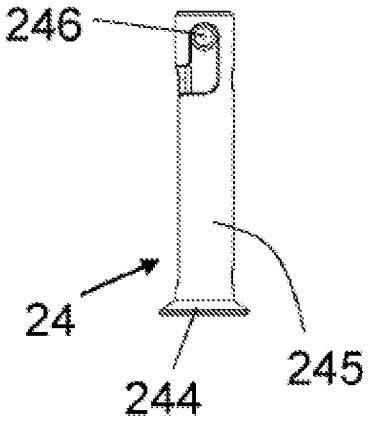
FIGS. 8A and 8B show detailed views of a illustrative pivot pin according to the present disclosure.
Figure 8B:
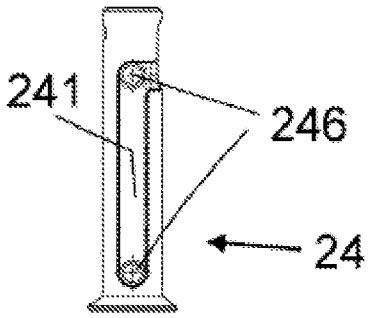

In the simplest embodiment, the pivot pin 24 can be a smooth, cylindrical, and in particular circular-cylindrical round pin; in the embodiment shown, the pivot pin 24 is designed having a head 244 and body 245 and a three-part cam 241 and detents 246 on the body 245 (FIGS. 8A and 8B).

Figure 4A:
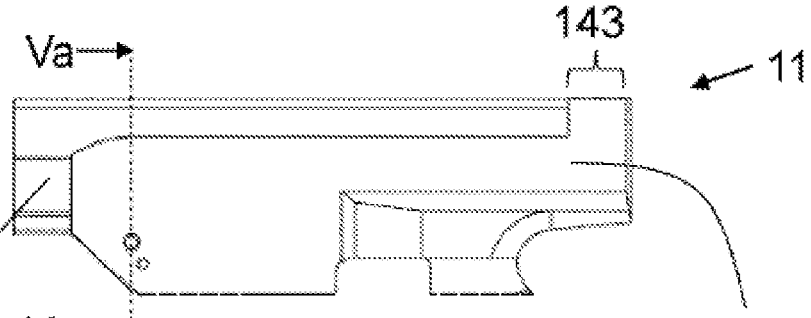
FIGS. 4A-4D show plan views of a firearm receiver section according to the present disclosure in the closed position (FIG. 4A), the unlocked position (FIG. 4B), the broken position (FIG. 4C), and the separated position (FIG. 4D).
Figure 4B:
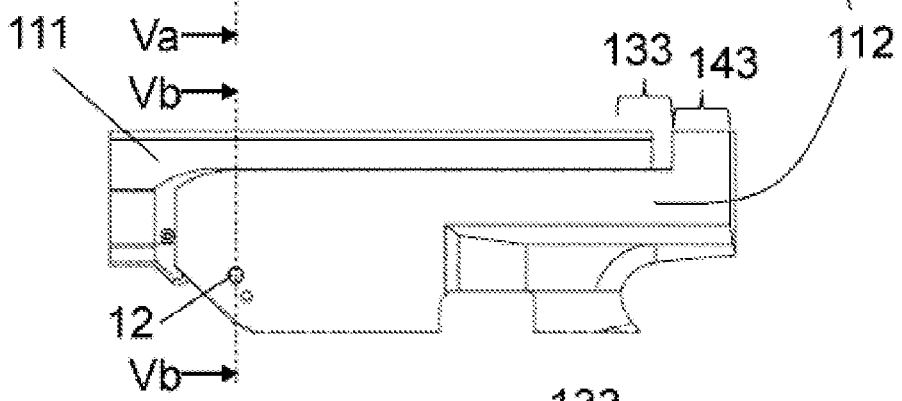
Figure 4C:
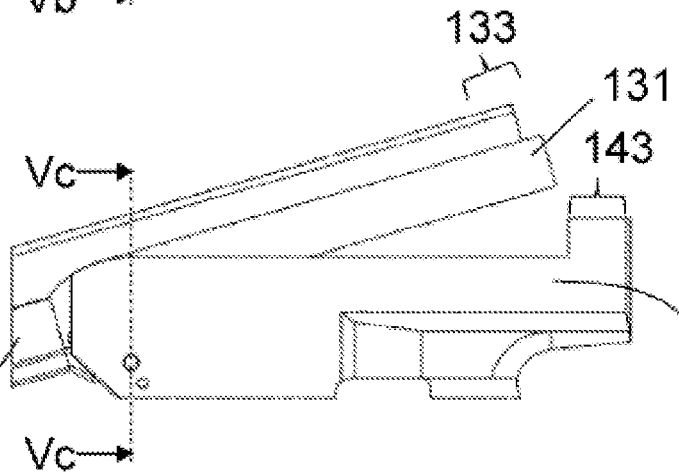
Figure 4D:
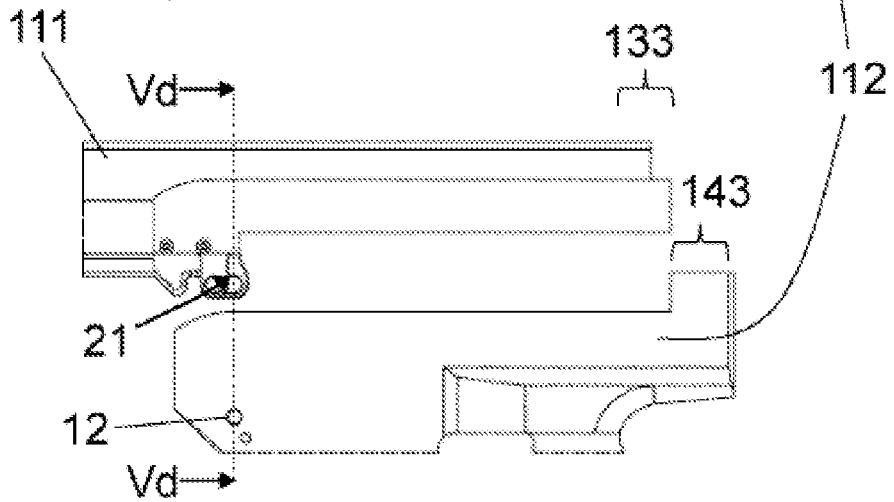
Figure 5A:
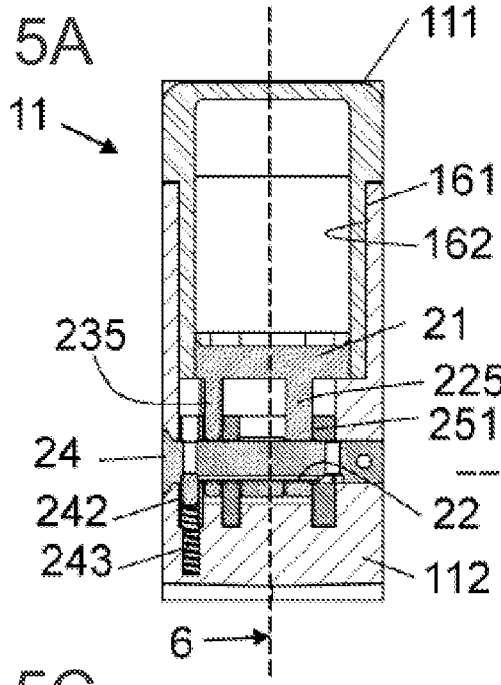
FIGS. 5A-5D show a cross-section view along the longitudinal axis of the pivot pin corresponding to FIGS. 4A-4D, respectively.

FIGS. 4A-4D each show a detail of the receiver 11 with the upper receiver part 111 and the lower receiver part 112, in a lateral plan view. FIG. 4A shows the receiver 11 in the closed state (closed position). FIG. 4B shows the receiver 11 in the unlocked state (unlocked position). The protrusion 131 is pushed completely out of the recess 141 in the running direction, and the end section 133 is thus spatially separated from the receiver end section 143. FIG. 4C shows the receiver in the broken state (tilted position). In the embodiment shown, the upper receiver part is tilted out of the lower receiver part about the pivot pin, which defines a pivot pin axis 247 that acts as the axis of rotation (here without reference number). The end section 133 is tilted upwards away from the receiver end section 143. In this position, the breech can be removed without having to completely dismantle the firearm, and cleaning is also easy. FIG. 4D shows the receiver 11 in the completely disassembled state, as it can be reached after removing the pivot pin: The upper receiver part 111 is completely separated from the lower receiver part 112 (separated position). FIGS. 5A-5D show the cross-sections of the receiver in the positions according to FIGS. 4A-4D, each in the section plane "Vn":

FIG. 5A shows the closed position. The upper receiver part 111 and the lower receiver part 112 lie one inside the other, the upper and lower guiding surfaces 161 and 162 lie against other. The pivot pin 24 is situated completely inside the receiver 11 and protrudes through the receiver pivot pin hole 12, the hole 22 formed on the stud 225 of the locking element 21 (clearly visible in FIG. 2), the slotted hole 23 formed on the lug 235 of the connector element 21 (see also FIG. 9B or FIG. 3), and the abutment pivot pin hole 256 (a hole, so-identified for differentiation) of the abutment 251. The pivot pin 24 has a cam 241 with detents, and is held in position by means of a spring-loaded plunger 242, 243, as will be explained below. The stud 225 lies axially in the plane of the pivot pin 24.

Figure 5B:
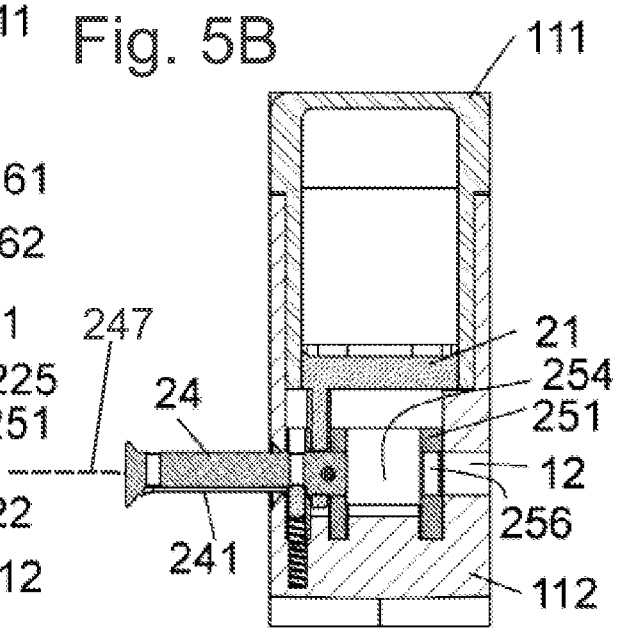

FIG. 5B shows the unlocked position. The pivot pin 24 is partially pulled out of the receiver 11 along its longitudinal pivot pin axis 247, and releases part of the receiver pivot pin hole 12, part of the abutment pivot pin hole 256, and also the hollow 254 and the hole 22. The movement of the pivot pin 24 is limited by the cam 241. In the unlocked position, the upper receiver part 111 and the lower receiver part 112 are displaced relative to each other parallel to the barrel axis 5, as compared to the closed position. The movement along the barrel axis 5 is limited by the interaction of the pivot pin 24 with the slotted hole 23. Tilting about the pivot pin 24 is not yet possible. This unlocking movement can be illustrated by comparing FIG. 2 and FIG. 7B. From this comparison, it can be deduced that the stud 225 visible in FIG. 5A (with hole 22 through which the locking pin 24 extends), in the unlocked position in FIG. 5B, is no longer in the plane of the pivot pin 24, and accordingly can no longer be seen in FIG. 5B. When the unlocking movement has been fully executed and the pivot pin 24 comes to stop in the second end 232 (FIG. 7A) of the slotted hole 23, a tilting about the axis 247 of the pivot pin 24 is possible.

Figure 5C:
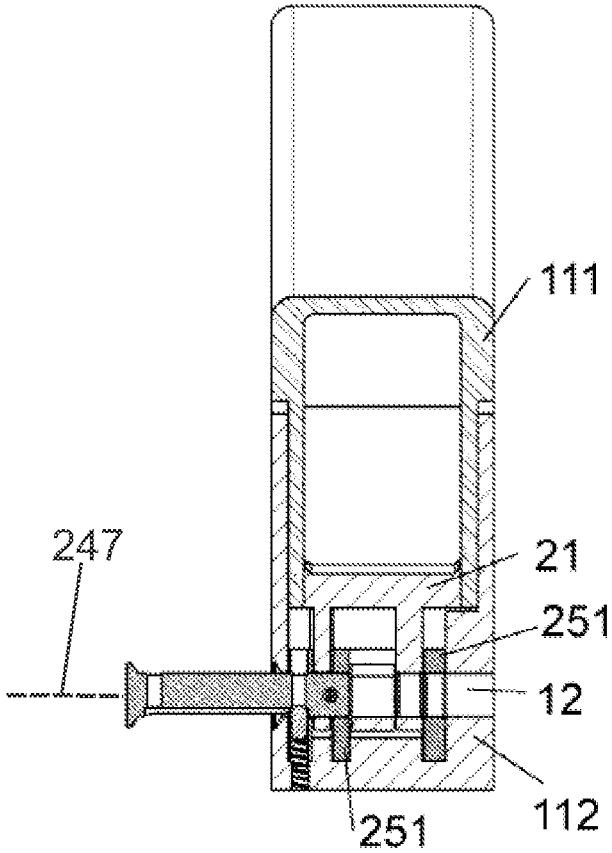

The tilted position is shown in FIG. 5*c*; this position is reached by rotating (pivoting) the upper receiver part 111 relative to the lower receiver part 112, with the longitudinal axis of the pivot pin 24 acting as the axis of rotation.

Figure 5D:
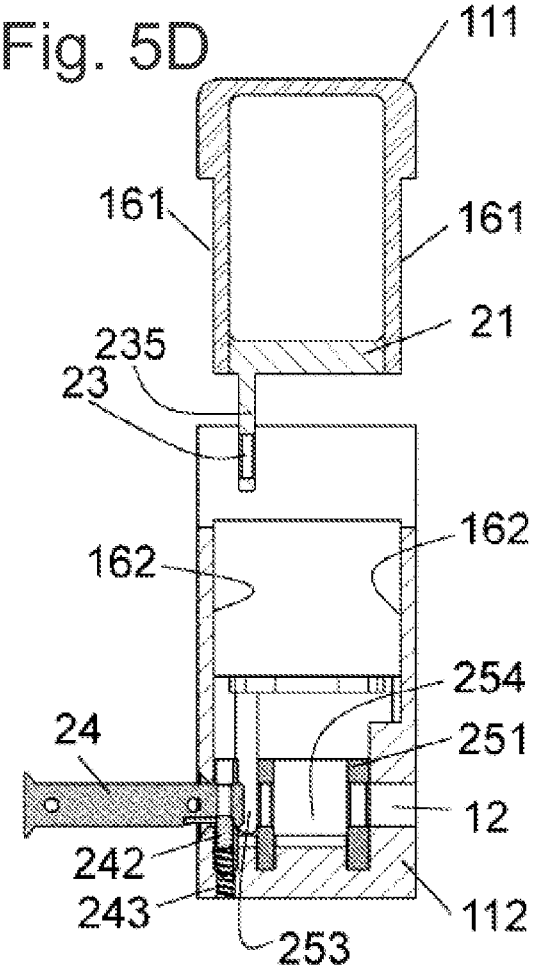

FIG. 5D shows the separated position; the upper receiver part 111 and the lower receiver part 112 are now completely separated from each other and no longer connected to each other. The pivot pin 24 is pulled out of the receiver 11 to the maximum extent along the third part of the cam, but is secured by a spring-loaded plunger 242, 243 engaging in a detent 246 (FIG. 8), to prevent it from falling out. In this position, the pivot pin 24 releases the lug 235 and the slot 253 (FIG. 9) and no longer protrudes into the slotted hole 23. Therefore, the upper receiver part can be completely separated from the lower receiver part.

Figure 6A:
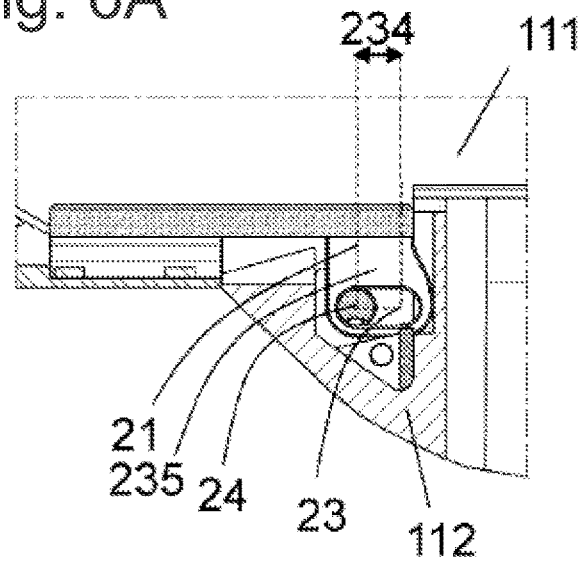
FIGS. 6A-6D show a partially cut-out longitudinal section corresponding to FIGS. 4A-4D, respectively.
Figure 6B:
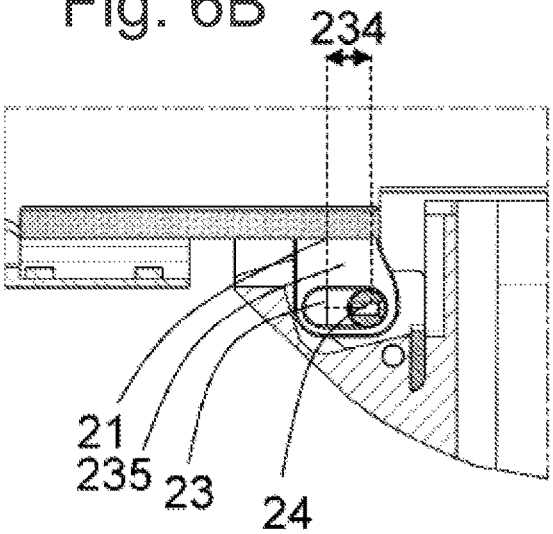
Figure 6C:
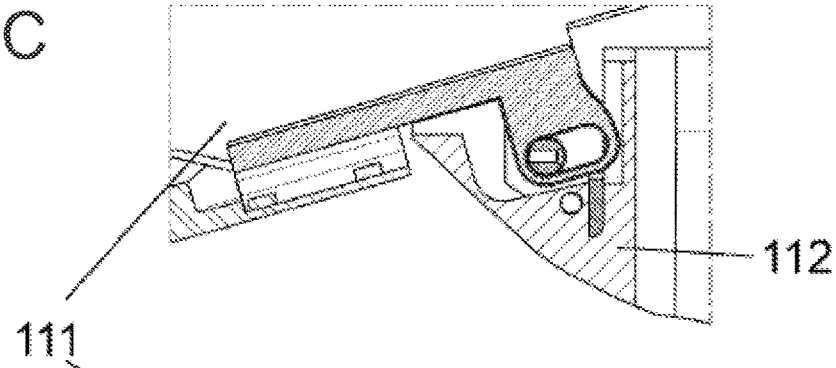

FIGS. 6A-6D show longitudinal sections of the receiver in the weapon median plane 6, in the positions according to FIGS. 4A-4D, the lower receiver part being partially cut out for better illustration. The movement of the upper receiver part 111 with the slotted hole 23 relative to the lower receiver part 112 by the span 234 (see also FIG. 7A) can be seen. In FIG. 6A, the closed position, the pivot pin 24 lies in the first (front, toward the muzzle) end 231 (FIG. 7A) of the slotted hole 23. In FIG. 6B, the unlocked position, the upper receiver part is moved by the span 234 (FIG. 7A) relative to the lower receiver part in the direction of the barrel. The pivot pin is in the second (rear, facing away from the muzzle) end 232 (FIG. 7A) of the slotted hole 23. FIG. 6C shows the tilted position. The upper receiver part 111 is tilted relative to the lower receiver part 112; the longitudinal axis 247 of the pivot pin 24 represents the axis of rotation, and the position of the pivot pin 24 is freely movable within the slotted hole 23.

Figure 6D:
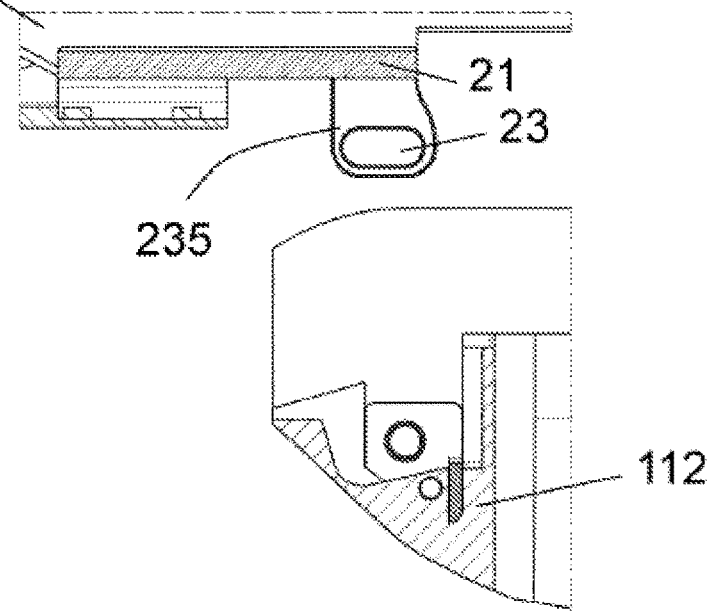

For the sake of completeness, the separated state is shown in the same longitudinal section in FIG. 6D.

Figure 7A:
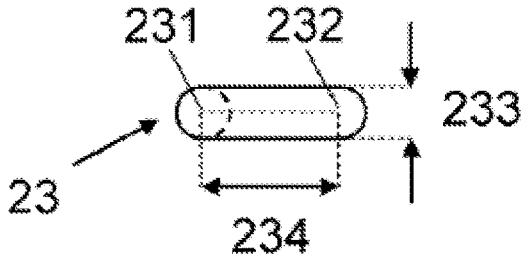
FIGS. 7A and 7B show detailed views of the slotted hole of the connector element and the protrusion, respectively.

In FIG. 7A, the slotted hole 23 of the connector element 21 is shown in a detailed view. The slotted hole 23 is an elongated bore with a semicircular first end 231 and a semicircular second end 232, and has a width (diameter) 233 that corresponds to the diameter of the first and second ends 231 and 232, and also at least substantially to the diameter of the receiver pivot pin hole 12 and to the diameter of the hole 22. The span 234 of the slotted hole 23 corresponds to the distance between the two center points of the two semicircles of the first and second ends 231 and 232, and must be at least as large (greater in practice) as the length 143 of the axial overlap 134 of the two receiver parts (FIG. 7B), so as to—on the one hand—reliably enable their contact (in the closed position) and—on the other hand—to ensure their disengagement (in the unlocked position). In practice, in the closed position, the pivot pin 24 should have "air" in front of the end position in order to reliably leave the axial contact between the two receiver parts to the stop surface 132 and the counter surface 142, and the two receiver parts should come free during axial displacement, at least right before the pivot pin reaches the other end position in the slotted hole, in order to reliably compensate for tolerances, thermal expansion, wear, etc.

Figure 7B:
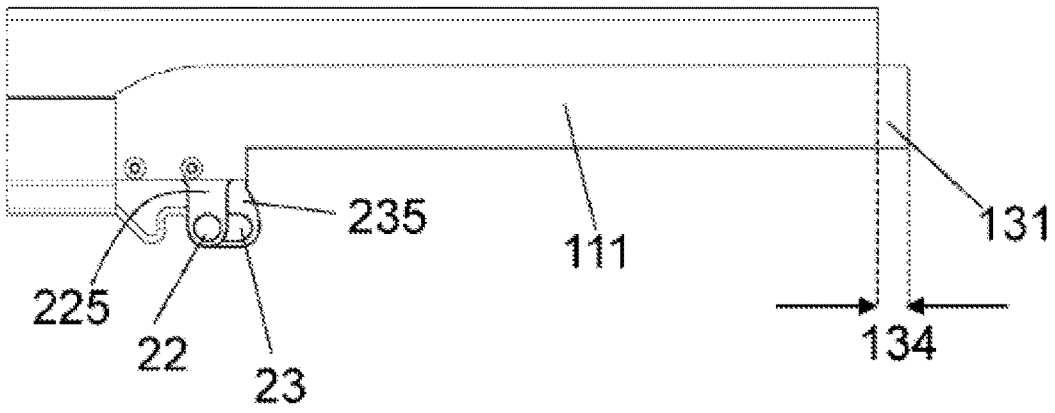

FIG. 7B shows the protrusion 131 on the upper receiver part 111 and the protrusion length 134. In order to allow a complete sliding out from the recess 141, and to allow the tilting into the tilted state, the protrusion length 134 of the protrusion 131 is less than the span 234 of the slotted hole 23. Preferably, the protrusion length 134 corresponds to 0.5 to 0.95 times the span 234.

FIGS. 8A and 8B show a preferred development of the pivot pin 24, with the head 244 and body 245, as well as with the cam 241 with detents 246, wherein the pivot pin 24 is shown rotated by 90° in FIGS. 8A and 8B. As illustrated, the cam 241 can be designed with three sections, i.e., in three parts, with two parts parallel to the pin axis and one part running in the circumferential direction, which merge into each other and are thus connected to each other. In the configuration shown, the cam has three radially recessed detents 246—for the closed, unlocked and separated positions.

In simple designs, the pivot pin can also be designed as a bare pin (circular cylindrical, without head and cam); other shapes with, for example a linear cam with or without detent and with or without loss protection, are also possible. In cooperation with the plunger, the cam can have a clearly defined stop point during the opening and closing. However, in addition, it can also be made flat so that it rotates automatically when the pivot pin is pressed. Designs with different cams for moving the pivot pin 24 in and out can also be contemplated.

Figure 9:
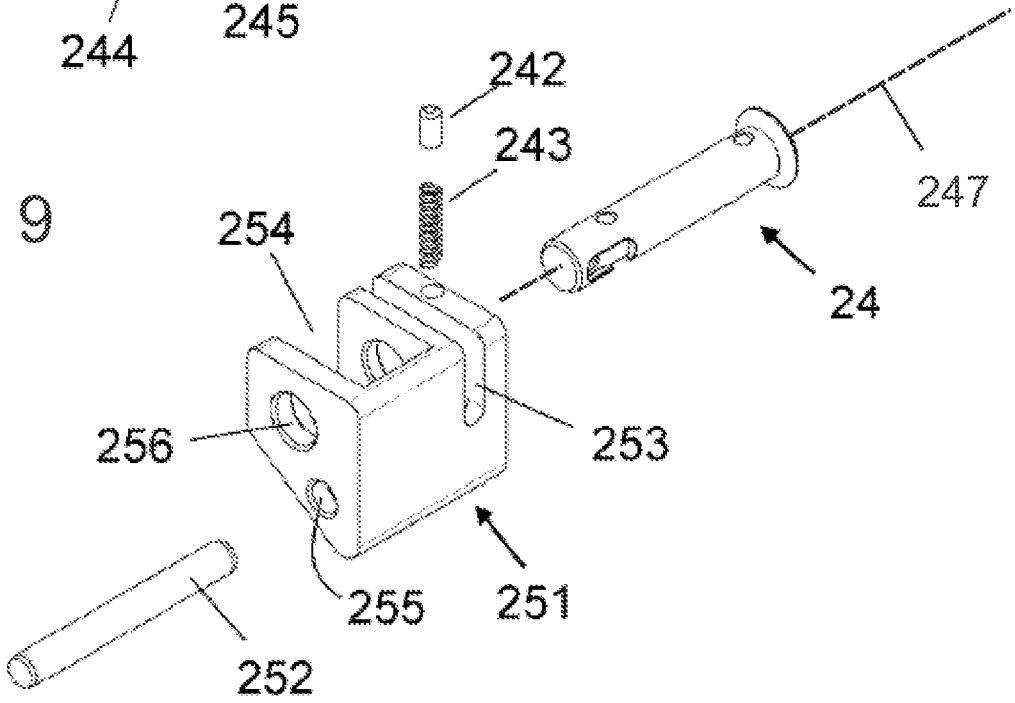
FIG. 9 shows a detailed view of an illustrative abutment according to the present disclosure.

The detent 246 cooperates with the spring-loaded plunger 242 and 243 shown in FIG. 9, which is arranged in the abutment 251 in the embodiment shown, and thus allows the pivot pin 24 to be held in the closed, unlocked and separated positions and to fix it in a releasable manner. In the separated position, this also has a loss-preventing effect; the pivot pin 24 remains connected with the receiver 11. The plunger 242 with the spring 243 can, for example and as shown in FIG. 9, be attached in the abutment 251. But it is also possible to attach the plunger 242 and spring 243 at another suitable location, for example in the receiver.

FIG. 9 also shows the abutment 251 located in the lower receiver part 112, which in the multi-part embodiment shown is fixed in the receiver by means of the retaining pin 252 and abutment retaining pin holes 255, 257 (FIG. 2). The abutment can also be formed integrally on the lower receiver part (or upper receiver part). The slot 253, which is at least substantially parallel to the weapon median plane 6, forms a guide for the lug 235 provided on the connector element 21 in the exemplary embodiment shown (see also FIGS. 6A-6D) with the slotted hole 23. The interaction of the lug 235 and the slot 253 when the upper receiver part and lower receiver part move relative to each other results in a guided and jam-free movement. In addition, the upper receiver part 111 and the lower receiver part 112 can be guided by their vertical overlaps on the sides with correspondingly designed upper and lower guiding surfaces 161 and 162.

The depth and the cross-section of the cam 241 and the depth and shape of the detents 246 are such that there is no unintentional movement of the pivot pin 24 due to the action of the spring 243 on the plunger 242. Rather, intentional and desired pulling (or during assembly: also pressing) makes removal possible without tools. Since the end face of the head is preferably aligned with the outside of the firearm, pressure must first be exerted on the opposite end face during dismantling, for example with the head of a cartridge, then the head 244 can be grasped and moved at the transition to the body 245.

Figure 10:
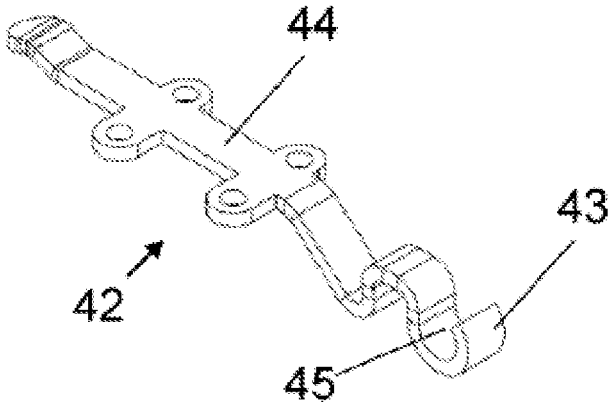
FIG. 10 shows a detailed view of an illustrative lock according to the present disclosure.

FIG. 10 shows the lock 42 in detail. On the mounting area 44, the lock 42 is connected to the handguard 41 (FIG. 2), for example by means of screws (not shown). In the closed (assembled) state, the molded hook 43 protrudes into the hollow 254 in the central region of the abutment 251 (FIG. 9) in such a way that the notch 45, with an inner diameter substantially corresponding to the slot width 233 (FIG. 7A), is concentric to the receiver pivot pin hole 12 (in the lower, FIG. 2) and the abutment pivot pin hole 256 (in the abutment, FIG. 9). The handguard 41 is thus held in position in the closed state by the interaction of the hook 43 on the lock 42 with the pivot pin 24, and an undesired movement of the handguard in the direction of the muzzle is prevented.

The lock 42 can be connected to the handguard 41 in a fixed manner or a manner allowing disassembly, for example by means of rivets, screws, gluing, welding, etc., or can also be formed integrally on the handguard 41. The hook 43 can be designed with the shape of a hook or with a functionally identical shaping, with a corresponding inner diameter, for example as an eyelet, sleeve, etc.

Figure 11A:
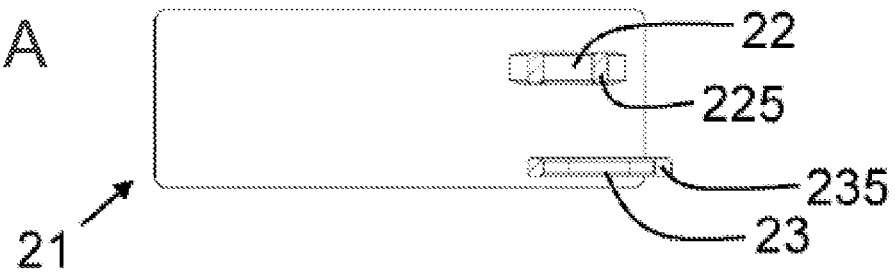
FIGS. 11A and 11B show detailed views of an illustrative connector element according to the present disclosure.
Figure 11B:
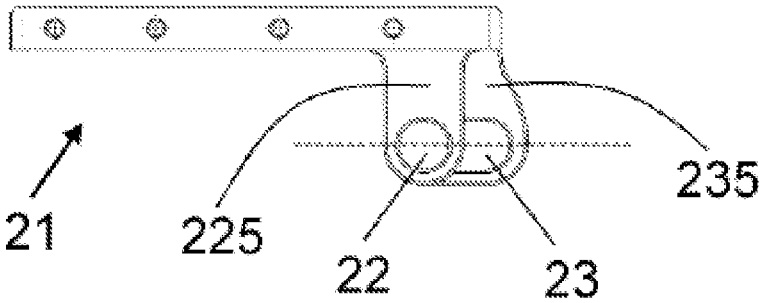

A preferred embodiment of the connector element 21, with a hole 22 and a slotted hole 23, is shown in FIGS. 11A and 11B. It comprises the already-described lug 235 on which the slotted hole 23 is formed, and the stud 225 with the hole 22. FIG. 11B shows a side view, and FIG. 11A shows a longitudinal section along the slotted hole median plane (dashed line in FIG. 11A).

Figure 12:
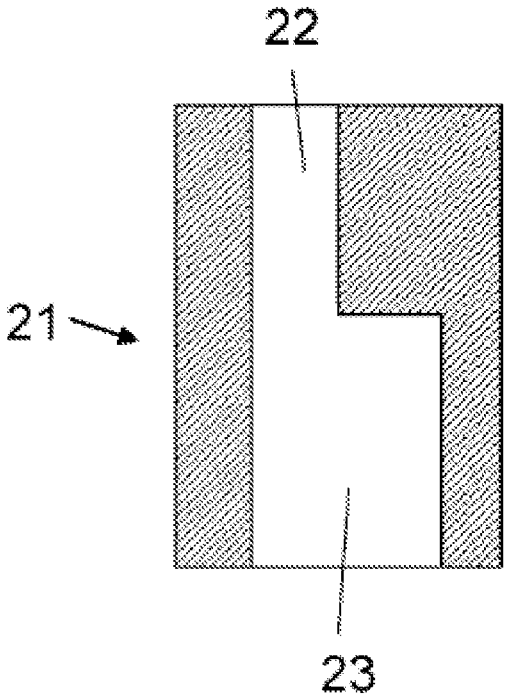
FIG. 12 shows a cross-section of an alternative illustrative connector element according to the present disclosure.

Other embodiments of the connector element, with the hole 22 and the slotted hole 23, are also possible. As a further example, a variant worked from the solid piece is shown in longitudinal section in FIG. 12, wherein the hollow 254 used to accommodate the lock 42 is dispensed with in this variant.

It is clear to the person skilled in the art after what has been said and shown that the slotted hole (or the connector element 21) does not have to be provided in the upper, but can instead be formed in the lower, which then also has a hole matching the longitudinal extension of the slotted hole; the pin is then (apart from rotation and axial displacement) fixedly arranged in the upper and executes the longitudinal movement with it.

Briefly, the present disclosure relates to a firearm having a weapon median plane 6, an upper receiver part 111 with a barrel 1 with a barrel axis 5, and a lower receiver part 112, which are detachably connected to each other, the connection comprising at least one pivot pin 24, around the axis of which, normal to the weapon median plane, the two receiver parts 111, 112 can pivot relative to each other between a closed position, which occurs in the ready-to-fire state, and an open position, and is characterized in that

- in the closed position, the pivot pin 24 protrudes through at least one hole, preferably an abutment pivot pin hole 256, in one of the two receiver parts 111, 112, and
- protrudes through a hole 22 and a slotted hole 23 in the other of the two receiver parts 112, 111; in that
- in the closed position, the slotted hole 23 runs at least substantially parallel to the barrel axis 5, in that
- in the closed position, the pivot pin 24 lies in one of the two end regions of the slotted hole 23, in that
- a protrusion 131 is provided at the rear of the upper receiver part 111, and a recess 141 is provided on the lower receiver part 112, and in that
- in the closed state, the protrusion 131 is pushed into the recess in the direction of the barrel axis 5.

In the case of a "retrofit," the invention relates to the ensemble of the abutment 254, connector element 21 and pivot pin 24 for suitable installation in a firearm—be it a pistol or rifle. Whether the installation is done by screwing, riveting, gluing, or in some other way is a question that a person skilled in the art can easily decide with knowledge of the present disclosure and the firearm to be converted.

The firearms of the present disclosure are not limited to the specific illustrated and described exemplary embodiments, but can be modified and configured in various ways. In particular, the shown cross-sectional shapes of the mentioned receiver parts, pins, rails, recesses, etc. can be adapted to the given basic data; the lengths and the positions with respect to the receiver can also be easily adapted by a person skilled in the art with knowledge of the invention. In particular, equivalent designs are obvious with knowledge of the disclosure and can be carried out without further ado by a person skilled in the art.

Thus, instead of the connector element 21, the holes 22, 23 provided there can be provided directly in the upper/lower. Regardless of this, the abutment 251 can have a different shape or it can be dispensed with, and the receiver pivot pin hole 12 in the lower/upper then takes on the role of guide without the abutment pivot pin hole(s) 256.

It should also be noted that in the description and the claims, terms such as the "lower region" of an object, refer to the lower half and in particular the lower quarter of the overall height; "lowermost region" refers to the lowermost quarter and in particular an even smaller part, while "central region" refers to the central third of the overall height. For the terms "width" and/or "length," this applies mutatis mutandis. All these terms have their generally accepted meaning, applied to the intended position of the object under consideration.

In the description and the claims, "substantially" means a deviation of up to 10% of the stated value, if physically possible, both downward and upward, otherwise only in the appropriate direction; in the case of degrees (angle and temperature), and for indications such as "parallel" or "normal," this means±10°. For terms such as "substantially constant" etc., what is meant is the technical possibility of deviation which the person skilled in the art proceeds from, and not the mathematical one. For example, a "substantially L-shaped cross-section" comprises two elongated surfaces, which merge at one end into the end of the other surface, and whose longitudinal extensions are arranged at an angle of 45° to 120° to each other.

All given quantities and percentages, in particular those relating to the limitation of the invention, insofar as they do not relate to specific examples, are understood to have a tolerance of±10%; accordingly, for example: 11° A means 9.9% to 12.1%. With terms such as "a solvent," the word "a" is not to be considered to represent a singular numeral, but rather is to be considered an indefinite article or pronoun, unless the context indicates otherwise.

The term: "combination" and/or "combinations," unless otherwise stated, mean all types of combinations, starting from two of the relevant components up to a plurality or all of such components; the term "containing" also means "comprising."

The features and variants stated in the individual embodiments and examples can easily be combined with those of the other examples and embodiments and in particular can be used for characterizing the invention in the claims without necessarily including the other details of the particular embodiment or of the particular example.

List of reference numbers:

| | | | |
|---|---|---|---|
| 1 | Barrel | 161 | Upper guiding surface |
| 2 | Grip | 162 | Lower guiding surface |
| 3 | Magazine | 20 | Connecting Mechanism |
| 4 | Stock | 21 | Connector element |
| 5 | Barrel axis | 22 | Round hole |
| 6 | Weapon median plane | 225 | Locking pin (stud) |
| 11 | Receiver | 23 | Slotted hole |
| 111 | Upper receiver part (Upper) | 231 | First end |
| 112 | Lower receiver part (Lower) | 232 | Second end |
| 12 | Receiver pivot pin hole | 233 | Diameter |
| 121 | Receiver pivot pin hole axis | 234 | Span |
| 131 | Protrusion | 235 | Lug |
| 132 | Rear stop surface | 24 | Pivot pin |
| 133 | Rear section | 241 | Cam |

-continued

| List of reference numbers: | | | |
|---|---|---|---|
| 134 | Protrusion length | 242 | Plunger |
| 141 | Recess | 243 | Spring |
| 142 | Receiver counter surface | 244 | Head |
| 143 | Receiver end section | 245 | Body |
| 151 | Groove | 246 | Detent |
| 152 | Front stop surface | 247 | Pivot pin axis |
| 41 | Handguard | 251 | Abutment |
| 42 | Lock | 252 | Retaining pin |
| 43 | Hook | 253 | Slot |
| 44 | Mounting area | 254 | Hollow |
| 45 | Notch | 255 | Abutment retaining pin hole |
| 451 | Guide rail | 256 | Abutment pivot pin hole |
| 452 | Handguard counter surface | 257 | Receiver retaining pin hole |

The invention claimed is:

1. A firearm having a weapon median plane, the firearm comprising:

an upper receiver part including a barrel having a barrel axis; and a lower receiver part detachably connected to the upper receiver part by a connecting mechanism;

wherein the connecting mechanism includes:

at least one pivot pin having a pivot pin axis normal to the weapon median plane, so that the upper receiver part and the lower receiver part are pivotable around the pivot pin axis between an open position and a closed position in which the firearm is in a ready-to-fire state;

a receiver pivot pin hole defined by and passing through the upper receiver part and/or the lower receiver part; wherein the receiver pivot pin hole defines a receiver pivot pin hole axis that is normal to the weapon median plane;

a connector element having at least one hole and at least one slotted hole, where each of the hole and the slotted hole define axes that are normal to the weapon median plane;

a protrusion formed on the upper receiver part or lower receiver part in the direction of the barrel axis, and a corresponding recess defined by the upper receiver part or lower receiver part that is complementary in shape and function to the protrusion;

wherein when the firearm is in the closed position:

the at least one pivot pin protrudes through at least the receiver pivot pin hole in one of the upper receiver part and the lower receiver part and through the hole and the slotted hole of the connector element in the other of the upper receiver part and the lower receiver part;

the slotted hole of the connector element extends in a direction that is at least substantially parallel to the barrel axis;

the at least one pivot pin lies in a first end of the slotted hole of the connector element arranged concentrically to the hole of the connector element; and the protrusion is pushed into the recess in the direction of the barrel axis.

2. The firearm according to claim 1, further comprising:

a rear stop surface formed on a rear of the upper receiver part; and a receiver counter surface formed on the lower receiver part;

wherein the rear stop surface and the receiver counter surface have regions of complementary shape that are configured so that when the firearm is in the closed position the rear stop surface and the receiver counter surface are in contact with each other.

3. The firearm according to claim 1, wherein a length of the protrusion is 0.5 times to 0.95 times a span of the slotted hole of the connector element.

4. The firearm according to claim 1, wherein the connector element having the hole and the slotted hole is connected to one of the upper receiver part and the lower receiver part.

5. The firearm according to claim 1, further comprising an abutment that is connected to one of the upper receiver part and the lower receiver part, wherein the abutment defines an abutment pivot pin hole.

6. The firearm according to claim 5, wherein the abutment pivot pin hole has a diameter that is the same as a diameter of the receiver pivot pin hole.

7. The firearm according to claim 5, wherein one of the connector element and the abutment is connected to one of the upper receiver part and the lower receiver part.

8. The firearm according to claim 1, wherein the pivot pin has a pivot pin head and a pivot pin body, and is configured so the pivot pin head has a larger diameter than the pivot pin body.

9. The firearm according to claim 8, wherein the pivot pin is configured so that a transition from the pivot pin body to the pivot pin head is conical in shape.

10. The firearm according to claim 8, wherein the pivot pin body defines a cam that is a groove-like recess in the pivot pin body, the recess having three contiguous sections including a first section extending longitudinally along the pivot pin body in a direction away from the pivot pin head, a second section extending in a circumferential direction around the pivot pin body, and a third section again extending longitudinally along the pivot pin body in the direction away from the pivot pin head.

11. The firearm according to claim 10, further comprising a plunger biased in the direction of the pivot pin by a spring, the plunger being disposed on the receiver part on which the receiver pivot pin hole is provided, and being configured to protrude into the cam defined by the pivot pin body.

12. The firearm according to claim 10, wherein the groove-like recess further defines a radially-recessed detent at a free end of the first section and/or at a transition from the first to the second section and/or at a free end of the third section.

13. The firearm according to claim 12, further comprising a plunger biased in the direction of the pivot pin by a spring, the plunger being disposed on the receiver part on which the receiver pivot pin hole is provided, and being configured to protrude into the radially-recessed detent.

14. The firearm according to claim 12, the firearm having an abutment that is connected to the one of the upper receiver part and the lower receiver part on which the receiver pivot pin hole is provided; further comprising a plunger that is biased in the direction of the pivot pin by a spring on the abutment, the plunger being configured to protrude into the cam defined by the pivot pin body.

15. The firearm according to claim 1, further comprising a handguard and a lock, where the lock includes a hook having a notch, an inner diameter of which corresponds to a diameter of the pivot pin body, and the lock is configured so that when the firearm is in the closed position the lock extends from an end of the handguard that is furthest from a muzzle of the firearm in the direction of the barrel axis to the pivot pin and engages the pivot pin by enclosing the pivot pin for at least part of its circumference with the hook and notch, so that the lock thereby determines a position of the handguard in the direction of the barrel axis.

16. The firearm according to claim 15, wherein the lock is integrally formed with the handguard.

17. The firearm according to claim 1, wherein the at least one slotted hole of the connector element has a first end and a second end, and the first end of the slotted hole of the connector element is arranged concentrically with the hole of the connector element.

18. The firearm according to claim 1, wherein the connector element is connected to one of the upper receiver part and the lower receiver part in a fixed manner, in a manner allowing disassembly, or the connector element is integrally formed on the receiver part.

19. The firearm according to claim 1, wherein the upper part or the lower receiver part is connected with the connector element in a fixed manner, in a manner allowing disassembly, or the connector element is integrally formed on the receiver part.

20. The firearm according to claim 1, wherein the abutment is connected to the upper receiver part or the lower receiver part in a fixed manner, in a manner allowing disassembly, or the abutment is integrally formed on the receiver part.

* * * * *